United States Patent [19]

Valvo

[11] Patent Number: 4,926,516

[45] Date of Patent: May 22, 1990

[54] FLOOR CARE APPARATUS

[76] Inventor: Russell Valvo, P.O. Box 1, 144 Lake St., Angola, N.Y. 14006

[21] Appl. No.: 258,030

[22] Filed: Oct. 14, 1988

[51] Int. Cl.[5] ..... A47L 11/18

[52] U.S. Cl. ..... 15/49 C; 15/23

[58] Field of Search ..... 15/23, 49 C, 50 C, 98, 15/41 R, 383; 51/176

[56] References Cited

U.S. PATENT DOCUMENTS 4,084,282 4/1978 Calvert ..... 15/23
4,238,867 12/1980 Ruggero ..... 15/23

FOREIGN PATENT DOCUMENTS 420423 10/1925 Fed. Rep. of Germany ..... 15/49 C
421343 11/1925 Fed. Rep. of Germany ..... 15/49 C

*Primary Examiner*—Edward L. Roberts

*Attorney, Agent, or Firm*—Hodgson, Russ, Andrews, Woods & Goodyear

[57] ABSTRACT

Floor care apparatus (10) capable of removing chewing gum or the like from a flooring (f) such as a carpet or the like. The floor care apparatus includes a housing (12) which is adapted to rest upon the floor covering, the housing having an electric motor (16) mounted therein. A wire brush (18) is mounted upon the arbor shaft (20) of the motor, the diameter of the wire brush being so sized with respect to the diameter of the housing that when the housing is resting upon the floor covering the wire brush may be readily moved into and out of engagement with the floor covering by moving the housing from operative to inoperative positions, which moving is accomplished by an operator who engages a handle (14) which is rigidly interconnected to the housing (12).

6 Claims, 1 Drawing Sheet

Fig. 1.
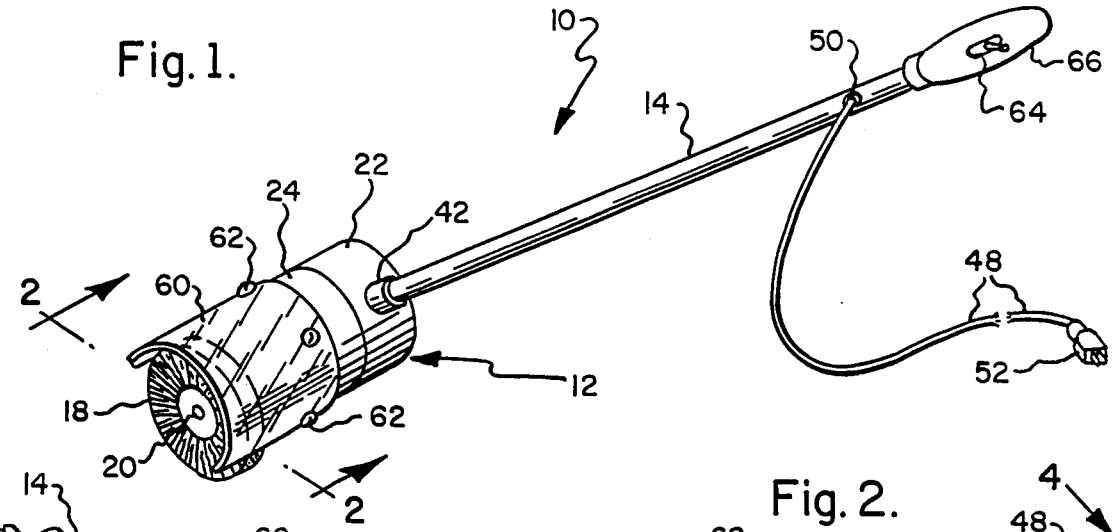
Fig. 2.
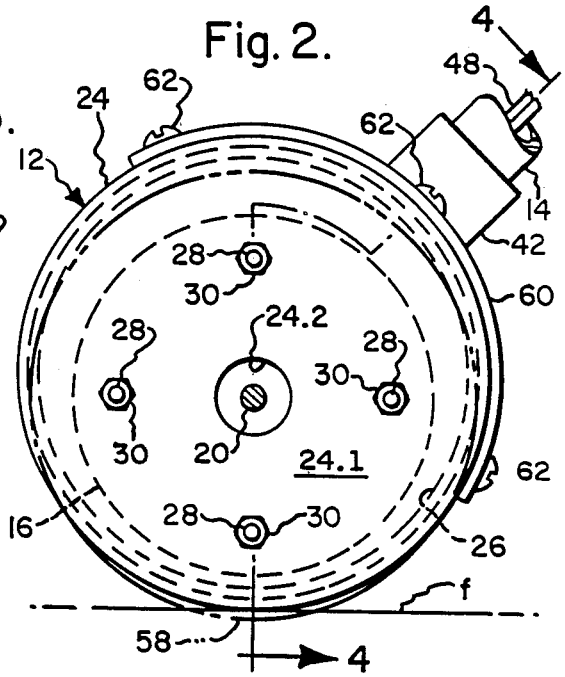
Fig. 3.
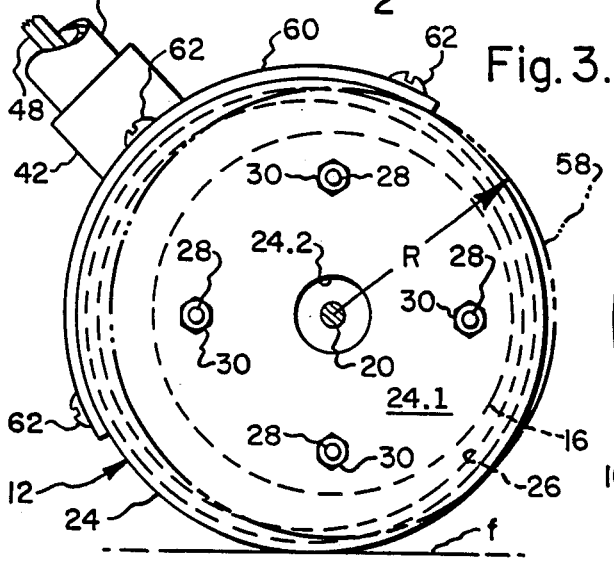
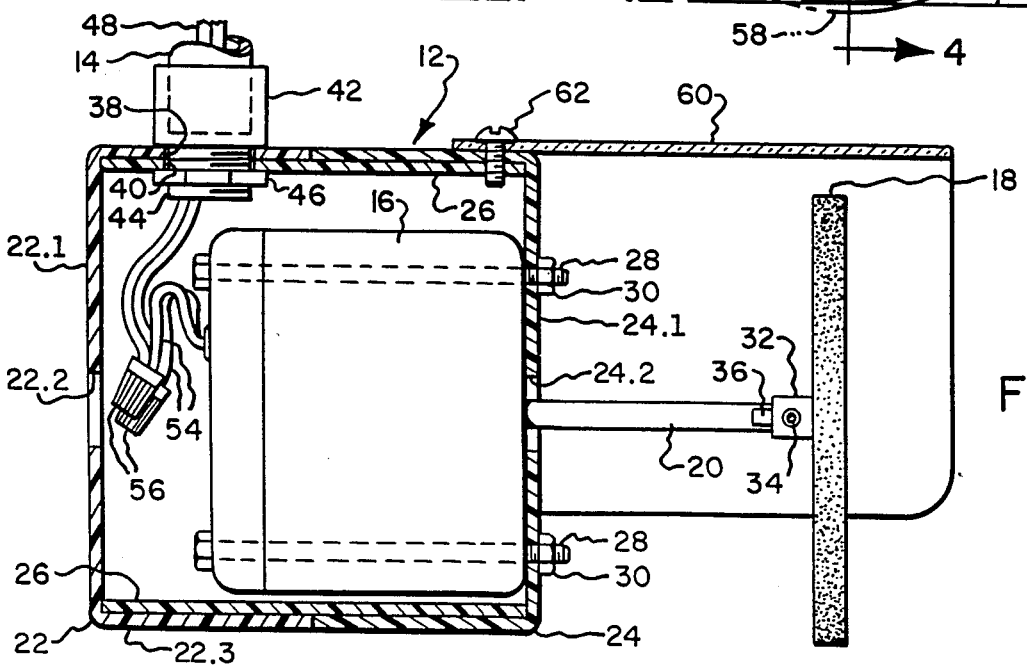
Fig. 4.

FLOOR CARE APPARATUS

TECHNICAL FIELD

The present invention relates generally to floor care apparatus, and more particularly to floor care apparatus which is capable of removing chewing gum or the like from flooring such as carpets and the like.

BACKGROUND OF THE INVENTION

One of the problems encountered in the maintenance of hotels, bowling alleys, etc. is the removal of chewing gum and the like from flooring such as carpets. In smaller establishments it is common practice to simply rub an ice cube on the chewing gum and them chip the frozen gum off. Larger establishments typically use the same principle but freeze the chewing gum by spraying it with a compressed gas such as freon or the like. In any event, the typical procedures are labor intensive and do not always provide satisfactory results.

OBJECTS AND SUMMARY OF THE INVENTION

It is the principal object of the present invention to provide a novel apparatus which is capable of removing chewing gum or the like from flooring or the like.

More particularly, it is an object of the present invention to provide an apparatus which will in effect disintegrate chewing gum, candy, and other materials, even when these materials have become embedded in a carpet, so that the disintegrated materials may be easily swept up.

In accordance with the above, it has been found that a four inch diameter wire brush, when rotated at approximately 1500 rpm, will effectively disintegrate chewing gum and the like, even when embedded in carpet, without damaging the flooring to which the gum is adhered. In view of this finding, an apparatus has been designed which includes a housing which is adapted to rest upon the flooring, the housing having an electric motor mounted therein. A wire brush is mounted on the arbor shaft of the motor, the diameter of the brush being so sized with respect to the diameter of the housing that when the housing is resting upon the flooring, the wire brush may be readily moved into and out of engagement with the flooring by rocking the housing, which rocking is accomplished by an operator who engages a handle which is secured to the housing.

The foregoing will become more apparent after a consideration of the following detailed description taken in conjunction with the accompanying drawings in which a preferred form of this invention is illustrated.

BRIEF DESCRIPTION OF THE DRAWINGS

FIG. 1 is an isometric view of the floor care apparatus of this invention, the floor care apparatus being shown in its normal upright or working position.

FIG. 2 is an end view of the apparatus shown in FIG. 1, this view being taken generally along the line 2—2 in FIG. 1 and showing the apparatus in an operative position.

FIG. 3 is a view similar to FIG. 2 but showing the apparatus in an inoperative position.

FIG. 4 is an enlarged side view of a portion of the floor care apparatus of this invention, this view being taken generally along the line 4—4 in FIG. 2.

DETAILED DESCRIPTION

Referring first to FIG. 1, the floor care apparatus of this invention is indicated generally at 10. The floor care apparatus includes, as major components, a two-part clam shell housing indicated generally at 12, a handle 14 which is rigidly secured to the housing, an electric motor 16 (FIG. 4) mounted within the housing, and a wire brush 18 mounted on the arbor shaft 20 of the electric motor. Two-part clam shell housing 12 is formed from separate sections 22, 24 of PVC sewer line end caps, each having an internal diameter of about 4¼ inches. The two sections 22, 24 are assembled together by telescoping them over another section 26 of PVC piping until adjacent ends of the end caps 22, 24 abut one another with the parts in concentric alignment.

When assembling the housing 12, initially the section 26 is telescoped into section 22 and is secured thereto by a suitable adhesive, which may be placed upon the inner surface of clam shell housing 22 prior to the parts being telescoped together. The ends 22.1 and 24.1 are preferably provided with apertures 22.2, 24.2 for the entry of cooling air. The electric motor 16 which may be a Dayton 3M547 1/20HP shaded pole motor, is mounted within the clam shell housing 24 which will be closest to the wire brush 18. The motor 16 is provided with four threaded mounting studs 28, which studs all lie an equal distance away from the arbor shaft 20, the studs 28 also being an equal distance away from each other. When the motor 16 is mounted within housing 24, the shaft 20 is passed through aperture 24.2, and then the mounting studs 28 are passed through suitable apertures (no number) and are secured in place by nuts 30. After the motor 16 has been properly secured to housing 24 the wire brush may be secured to shaft 20. To this end, the wire brush is provided with a sleeve 32 which may be telescoped over the end of shaft 20, the sleeve carrying a set screw 34 which may be turned to engage the flat 36 on shaft 20, thereby fixing brush 18 to shaft 20.

Aligned apertures 38, 40 are drilled into the housing section 22 and telescoping section 26 after these parts have been secured together. One end of the hollow handle 14, which may be made of PVC piping, is then inserted into the upper end of connector 42 and is adhesively secured thereto. The connector also has a reduced diameter threaded end portion 44. The shoulder between the reduced diameter portion 44 and the portion which receives the end of the handle will act as an abutment. After the handle is secured to the connector 42, the reduced diameter portion therein is inserted into the apertures. The threaded end 44 of the connector 42 is secured within apertures 38, 40 by a nut 46.

An electric power line 48 extends through the hollow handle, a portion of the power line 48 passing through a suitable grommet 50 on an upper side portion of the handle and terminating in a plug 52. A lower end of the electric power line 48 is suitably secured to the electric motor wires 54 by connectors 56.

As previously indicated, the arbor shaft 20 has mounted thereon a wire brush 18. One such suitable wire brush is made by Fuller Tool, however other suitable brushes may also be utilized. In the preferred embodiment illustrated the radius R of the wire brush is 2 inches. In addition, the diameter of the electric motor is 3¼ inches whereas the internal diameter of the sleeve or section 26 is 4 inches. In view of these relationships it is possible to mount the motor in an offset manner so that the periphery of the wire brush extends beyond the periphery of the clam shell housings 22, 24 which support the floor care apparatus of this invention when it is in its operative position as shown in FIG. 2. Thus, it can be seen from FIG. 2, wherein the periphery of the wire brush is illustrated by a dot-dash line 58, that the wire brush may actually extend into a flooring f a small amount, as for example when the flooring is a carpet. However, it can be seen from FIG. 3 that if the floor care apparatus of this invention is rotated approximately 90° that the periphery 58 of the wire brush will actually be disposed above the flooring f. In addition, it should also be appreciated from FIG. 4 that if the apparatus were rocked to the left about a lower support portion 22.3 of the clam shell housing 22 that the periphery of the wire brush 18 would also be moved to a raised inoperative position. Thus, in operation, it is possible to rock the apparatus from side to side placing it in operative or inoperative positions. In addition, it is possible to rock the apparatus from the position shown in FIG. 2 to the position shown in FIG. 3 to move the apparatus from operative to inoperative positions. The actual manner of use will depend upon the particular preferences of the operator utilizing this device.

In order to give some protection to the operator from any flying debris which may be generated by the wire brush during operation of this apparatus, a clear plastic shield 60 is mounted upon the reduced diameter portion of the housing portion 24, the shield being mounted upon this section by screws 62. The shield will permit the operator to view the work area through the shield, when the brush is in operation. The screws 62 not only secure the shield to housing portion 24, but also secure housing portion 24 to the telescoping section 26. As the arbor shaft 20 is offset from the centerline of the housing 24, it is necessary when assembling two parts to insure that the arbor shaft is in the proper orientation with respect to the handle 14. Thus, after the housing section 24 has been telescoped onto section 26 it may be necessary to rotate the parts with respect to one another before the screw holes are drilled through housing section 24 and 26. The screws 62 are preferably self tapping screws.

It should be noted that an electric power line switch 64 is mounted on the handle 14 above the grommet 50 and adjacent a hand grip portion 66 of the handle. Thus, the operator, when holding the handle by the hand grip and by engaging the switch 64 can easily turn the apparatus on and off. While the apparatus shown is adapted to be powered by a line cord, it may also be battery powered.

Although the apparatus of the present invention was developed initially for removing chewing gum from carpets, it has been found to perform in a satisfactory manner when removing wax, candles, plaster, and other items. In addition it has been found that it will perform in a satisfactory manner on other flooring, such as cement sidewalks and tile flooring.

While a preferred structure in which the principles of the present invention have been incorporated is shown and described above, it is to be understood that this invention is not to be limited to the particular details shown and described above, but that, in fact, widely differing means may be employed in the broader aspects of this invention. For example, the housing 12 may be additionally provided with a wheel, which wheel could be mounted on a shaft in line with the lowermost stud 28 the wheel projecting through the housing to provide a support surface equivalent to that shown at 22.3.

What is claimed is:

1. Floor care apparatus capable of removing chewing gum or the like; from flooring such as carpets or the like, the floor care apparatus comprising:

a housing having a generally cylindrical non-rotatable portion a segment of which is disposed upon the flooring when the housing is in an operative position, the housing being rockable to an inoperative position;

an electric motor mounted within the housing, the motor having an arbor shaft which extends beyond one side of the housing, the motor being mounted in such a manner that the arbor shaft is generally parallel to the surface of the flooring when the housing is in an operative position;

a wire brush mounted on the arbor shaft beyond one side of the housing, the periphery of the wire brush engaging the surface of the flooring when the housing is in an operative position and the periphery of the wire brush not engaging the surface of the flooring when the housing is rocked to an inoperative position;

a control handle having one end rigidly interconnected with said generally cylindrical portion of the housing and mounted so that it is generally perpendicular to the axis of the arbor shaft, the other end of the control handle being provided with a hand grip or the like, the handle being capable of the causing the housing to be rocked between its operative and inoperative positions;

power line means to power up the electric motor to cause the wire brush to be rotated, at least a portion of the power line means extending through the control handle; and a clear shield having an edge portion mounted on the cylindrical portion of the housing, which clear shield extends beyond one side of the housing above the wire brush when the floor care apparatus is in an operative position.

2. The floor care apparatus as set forth in claim 1 wherein the housing is of a clam shell construction, each half of the clam shell construction being generally cylindrical, the handle being secured to one half and the electrical motor being secured to the other half.

3. The floor care apparatus as set forth in claim 1 wherein the electric motor is of the type which will easily stall out.

4. Floor care apparatus capable of removing chewing gum or the like from flooring such as carpets or the like, the floor care apparatus comprising:

a generally cylindrical housing, a portion of which is adapted to be disposed upon the flooring, the housing being movable between operative and inoperative positions;

an electric motor including an arbor shaft, the motor being mounted within the housing with the arbor shaft extending to one side, the motor being mounted in such a manner that the arbor shaft is offset from the center line of the generally cylindrical housing;

a wire brush mounted on the arbor shaft, the diameter of the wire brush being not more than the diameter of the generally cylindrical housing, the periphery of the wire brush being capable of engaging the surface of the floor covering when the housing is in an operative position wherein the arbor shaft is disposed below the center line of the generally cylindrical housing to an inoperative position wherein the arbor shaft is disposed above the center line of the generally cylindrical housing;

means to power up the electric motor whereby the wire brush is caused to be rotated; and a control handle having one end rigidly interconnected with said generally cylindrical housing, the other end of the control handle being provided with a hand grip or the like, the handle being capable of moving the housing between its operative and inoperative positions.

5. Floor care apparatus capable of removing chewing gum or the like from flooring such as carpets or the like, the floor care apparatus comprising:

a generally cylindrical housing, a surface of which is adapted to be disposed upon a floor covering, the housing including first and second clam shell housing portions and a telescoping member to which the clam shell housing portions are secured, the housing being movable between operative and inoperative positions;

an electric motor including an arbor shaft, the motor being mounted within one of the clam shell housing portions with the arbor shaft extending to one side, the motor being mounted in such a manner that the arbor shaft is offset from the center line of the generally cylindrical housing;

a wire brush mounted on the arbor shaft, the diameter of the wire brush being not more than the diameter of the generally cylindrical housing, the periphery of the wire brush being capable of engaging the surface of the floor covering when the housing is in an operative position wherein the arbor shaft is disposed below the center line of the generally cylindrical housing to an inoperative position wherein the arbor shaft is disposed above the center line of the generally cylindrical housing;

means to power up the electric motor whereby the wire brush is caused to be rotated when the motor is powered up; and a control handle having one end rigidly interconnected with said generally cylindrical housing, the other end of the control handle being provided with a hand grip or the like, the handle being capable of moving the housing between its operative and inoperative positions.

6. The floor care apparatus as set forth in claim 5, said apparatus further comprising a shield adapted to be disposed over said wire brush, and fastening means capable of securing the shield to one of the clam shell housing portions and also to secure the one clam shell housing portion to the telescoping portion.

* * * * *